US007510187B2

(12) United States Patent
Haag

(10) Patent No.: US 7,510,187 B2
(45) Date of Patent: Mar. 31, 2009

(54) PERSONALIZED JIGSAW PUZZLE

(76) Inventor: Maia Haag, 4305 Chimo E. St., Wayzata, MN (US) 55391

( * ) Notice: Subject to any disclaimer, the term of this patent is extended or adjusted under 35 U.S.C. 154(b) by 16 days.

(21) Appl. No.: 11/227,886

(22) Filed: Sep. 15, 2005

(65) Prior Publication Data

US 2007/0057458 A1 Mar. 15, 2007

(51) Int. Cl.
*A63F 9/10* (2006.01)

(52) U.S. Cl. ..... 273/157 R

(58) Field of Classification Search ..... 273/157 R, 273/156; D21/480
See application file for complete search history.

(56) References Cited

U.S. PATENT DOCUMENTS

| | | | | | |
|---|---|---|---|---|---|
| 163,912 | A | * | 6/1875 | Birmeli | 273/157 R |
| 1,383,097 | A | * | 6/1921 | Gibson | 273/157 R |
| 1,907,382 | A | * | 5/1933 | Birdsall | 273/157 R |
| 2,953,380 | A | * | 9/1960 | Hasenbach | 273/157 R |
| 3,302,310 | A | | 2/1967 | Leven | |
| 3,964,750 | A | * | 6/1976 | Brown | 273/517 R |
| 4,053,159 | A | | 10/1977 | Kulak | |
| 4,361,328 | A | | 11/1982 | Stein et al. | |
| 4,612,220 | A | * | 9/1986 | Baxter | 273/157 R |
| 4,776,802 | A | * | 10/1988 | Rind et al. | 273/157 R |
| 5,232,088 | A | * | 8/1993 | Leondidis | 273/157 R |
| 5,257,785 | A | | 11/1993 | Sugie | |
| 5,368,301 | A | | 11/1994 | Mitchell | |
| D353,415 | S | | 12/1994 | Mitchell | |
| 5,409,227 | A | | 4/1995 | Walker | |
| 5,439,221 | A | | 8/1995 | Harvie | |
| 5,600,910 | A | | 2/1997 | Blackburn | |
| 5,605,332 | A | | 2/1997 | Harnett | |
| 5,813,154 | A | * | 9/1998 | Wilford | 273/157 R |
| 5,865,928 | A | | 2/1999 | Lariviere, Jr. et al. | |
| 5,957,454 | A | | 9/1999 | Libeskind | |
| 5,988,687 | A | | 11/1999 | Krisch | |
| 6,517,071 | B2 | | 2/2003 | Gallant | |
| 6,619,661 | B1 | * | 9/2003 | Collins | 273/157 R |
| 6,663,732 | B1 | | 12/2003 | Link | |
| 2003/0007836 | A1 | | 1/2003 | Clarke et al. | |
| 2003/0067114 | A1 | | 4/2003 | Morioka | |
| 2003/0181251 | A1 | | 9/2003 | Morioka | |

FOREIGN PATENT DOCUMENTS

| | | |
|---|---|---|
| EP | 1023928 | 1/1999 |
| WO | WO 8001990 | 3/1980 |

* cited by examiner

*Primary Examiner*—Steven Wong
(74) *Attorney, Agent, or Firm*—Brooks, Cameron & Huebsch, PLLC

(57) ABSTRACT

A personalized jigsaw puzzle and a method for production of personalized puzzles are described with the personalized puzzle capable of being produced without a customized printing. The personalized jigsaw puzzle is suitable for use as an educational tool and to develop creativity. The personalized puzzle contains a picture and a customized message. Pieces making up the picture have a unique shape, while a portion of the message section pieces are identically shaped and are interchangeable. These pieces can include one or more alphanumeric characters, contain graphic art or be blank. The message section can also be customized, including having an adjustable size.

11 Claims, 3 Drawing Sheets

PERSONALIZED JIGSAW PUZZLE

FIELD OF THE INVENTION

The present invention relates to jigsaw puzzles, and more particularly to a personalized jigsaw puzzle having a puzzle picture and a custom message.

BACKGROUND OF THE INVENTION

Known jigsaw puzzles include pieces shaped to interlock with one another so as to form a picture. In typical jigsaw puzzles, each piece is shaped differently from all other pieces so that each piece may only fit in one defined position. This allows for assembling and display of a puzzle picture. In this type of puzzle, including a custom message requires reprinting the entire puzzle.

A personalized puzzle with a custom message is desirable as a educational tool, such as for helping children learn to spell their names. In other instances, a personalized puzzle containing a custom message is desirable to commemorate a special occasion or to provide a unique gift. However, the difficulty of reprinting a different entire puzzle for each personalized puzzle makes production of personalized puzzles expensive. There is a need for personalized puzzles and a method for producing personalized puzzles that does not require the expensive process of reprinting a different entire puzzle for each personalized puzzle.

If a personalized puzzle may be produced without using a custom process, the cost for each personalized puzzle can be much reduced. Furthermore, the time necessary to produce each personalized puzzle will also be much reduced. It is therefore an object of the present invention to provide a personalized puzzle with a custom message useful for educational and other purposes that can be produced using an easy and affordable process.

Different personalized puzzles may require varying amounts of room to contain a custom message. It is therefore a further object of the present invention to provide a personalized puzzle that is adaptable to different lengths of a custom message.

A personalized puzzle can also help development of creativity by providing for flexibility in the assembly of the puzzle. It is therefore a further object of the invention to provide a puzzle allowing for flexibility in assembly without the use of a custom process.

SUMMARY OF THE INVENTION

The invention therefore provides for a personalized jigsaw puzzle that can be customized without the need for a custom printing. The invention further provides a method for manufacturing a personalized puzzle. The puzzle contains a picture section and a message section. Picture section pieces have a unique shape, while at least a portion of the message section pieces have substantially identical shapes and are interchangeable. The interchangeable pieces can include one or more alphanumeric characters, contain graphic art or be blank on a top surface.

In other aspects of the present invention, the method includes customization of the message section.

In further aspects of the present invention, the method includes adjustable sizes of the message section.

In still further aspects of the present invention, the personalized jigsaw puzzle provides for flexibility during assembly of the puzzle.

These and further objects and advantages of the present invention will become clearer in light of the following detailed description of an illustrative embodiment of this invention described in connection with the drawings.

BRIEF DESCRIPTION OF THE DRAWINGS

The illustrative embodiment may best be described by reference to the accompanying drawings where.

Figure 1:
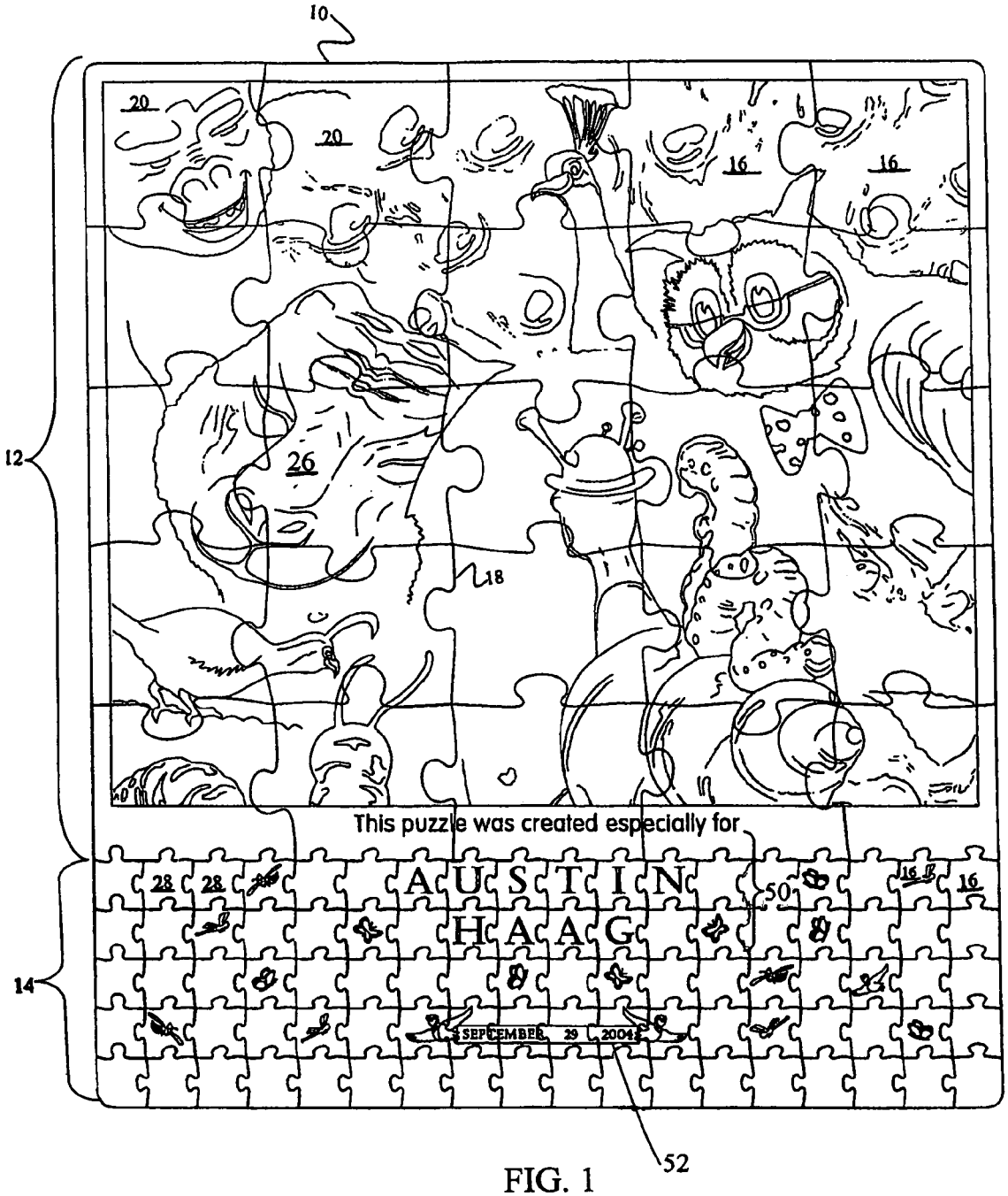
FIG. 1 shows an example embodiment of the personalized jigsaw puzzle of the invention having a picture section and a message section.

All figures are drawn for ease of explanation of the basic teachings of the present invention only; the extensions of the figures with respect to number, position, relationship, and dimensions of the parts to form the preferred embodiment will be explained or will be within the skill of the art after the following description has been read and understood. Further, the exact dimensions and dimensional proportions to conform to specific specifications will likewise be within the skill of the art after the following description has been read and understood. Values provided are representative and are utilized to facilitate the description of the preferred embodiment.

Where used in the various figures of the drawings, the same numerals designate the same or similar parts. Furthermore, when the terms "upper," "lower," "side," "end," "bottom," "first," "second," "laterally," "longitudinally," "row," "column," "array," and similar terms are used herein, it should be understood that these terms have reference only to the structure shown in the drawings as it would appear to a person viewing the drawings and are utilized only to facilitate describing the illustrative embodiment.

DETAILED DESCRIPTION OF THE PREFERRED EMBODIMENTS

Figure 2:
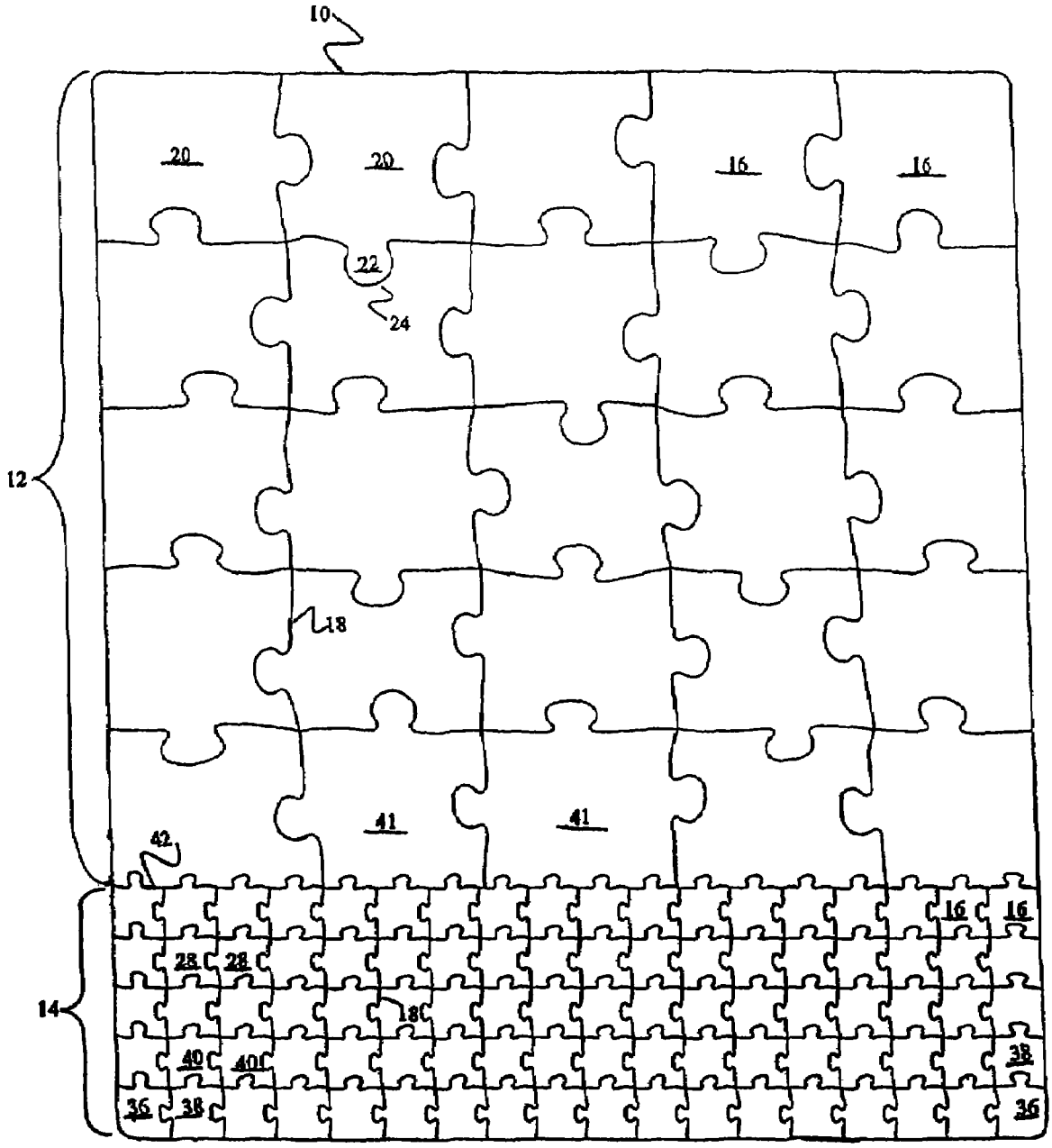
FIG. 2 shows an example embodiment of the personalized jigsaw puzzle of the invention with the die lines shown.

Refer now to FIG. 1, which shows one example embodiment of the personalized jigsaw puzzle of the invention. The jigsaw puzzle 10 includes a picture section 12 and a personalized section 14. As shown in FIG. 2, the jigsaw puzzle 10, when assembled, forms a sheet made up of separate puzzle pieces 16 as defined by die lines 18. The picture section 12 is made up of picture pieces 20. The picture pieces 20 are shaped to have extensions 22 and receptacles 24 that allow the picture pieces 20 to interlock with one another. In the preferred embodiment, each picture piece 20 has a unique shape such that the picture pieces 20 interlock together in only one conformation. This advantageously allows assembly of the picture pieces 20 to display a puzzle picture 26 on a top surface when the picture section 12 is assembled.

Figure 3:
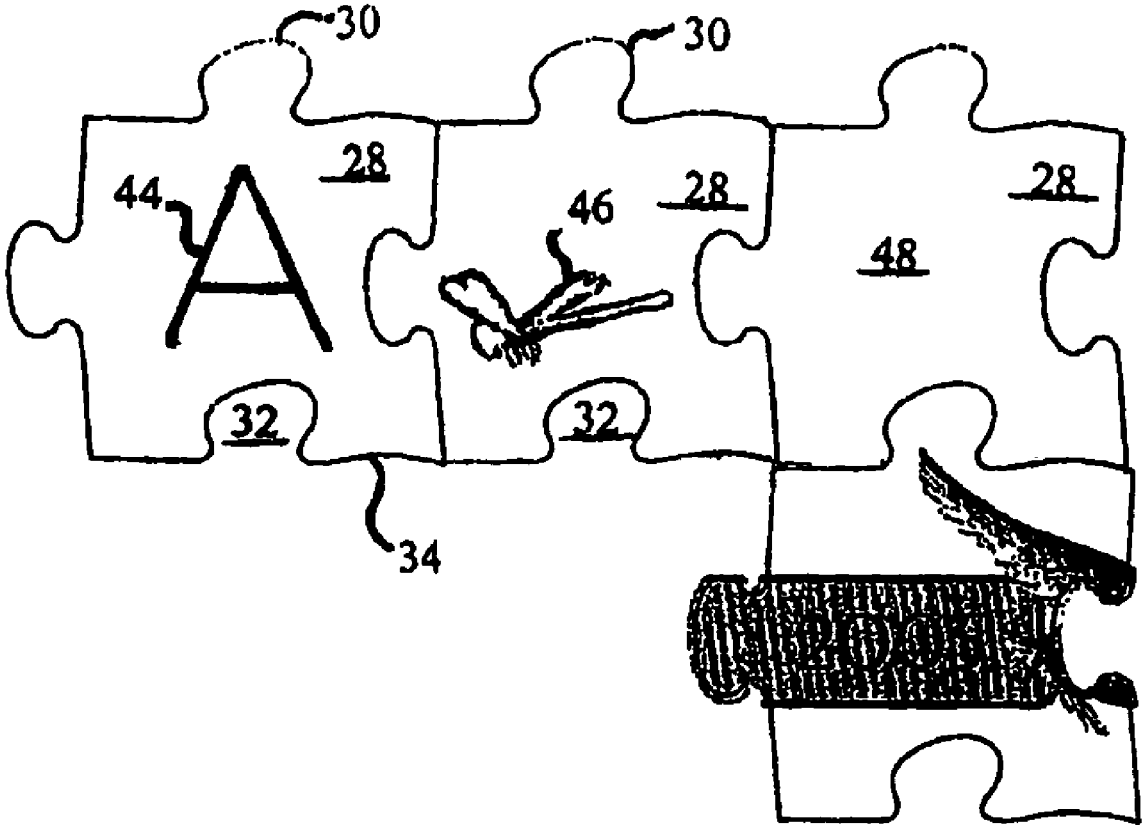
FIG. 3 shows an example embodiment of three message pieces of the personalized jigsaw puzzle of the invention.

In the preferred embodiment, the personalized section 14 of the personalized jigsaw puzzle 10 of the invention is made up of message pieces 28, such as shown in FIG. 3. The message pieces 28 likewise have extensions 30 and receptacles 32 that allow the message pieces 28 to interlock with one another. In the preferred embodiment, a selected portion of the personalized section 14 is made of message pieces 28 having a substantially identical shape. The identical shape allows the identically shaped message pieces 34 to be freely interchangeable with one another. Thus, there are multiple possible conformations for the personalized section 14. Furthermore, any identically shaped message piece 34 can be substituted for any other identically shaped message piece 34.

In one example embodiment, the personalized section includes corner pieces 36, border pieces 38 and interior pieces 40. In this preferred embodiment, all interior pieces 40 of the personalized section 14 have a substantially identical shape and may be joined with any other of the interior pieces 40. Similarly, selected border pieces 38 can have an identical shape. For example, in this preferred embodiment, border pieces 38 forming the left border are shaped identically. Likewise, border pieces 38 forming the bottom border are shaped identically, and border pieces 38 forming the right border are shaped identically.

In the preferred embodiment, the picture section 12 interfaces with the personalized section 14 using pieces having extensions and receptacles that allow picture pieces 20 and message pieces 28 at the interface 42 to interlock. In this example embodiment, interface picture pieces 41 have an interface 42 that allows any of the identically shaped message pieces 34 to interlock with any of the interface picture pieces 41. In the picture section 12, each interface picture piece 41 has a specific position relative to the other picture pieces 20. Conversely, in the personalized section 14, any of the message pieces 28 can serve as any part of the interface 42.

In this preferred embodiment, the interior message pieces 40 may display an alphanumeric character piece 44, a graphic piece 46, or may be a blank piece 48. Alphanumeric pieces 44 can advantageously be selected to allow for composition of a custom message 50. In one embodiment, an alphanumeric piece 44 may display a single letter or numeral. In an alternate embodiment, multiple letters may be displayed on an alphanumeric piece 44. In yet another embodiment, the custom message 50 may combine alphanumeric pieces 44 having single letters and multiple letters. In an alternate embodiment, message pieces 28 may include a design 52 traversing multiple message pieces 28. In this embodiment, the design 52 can be used to show the spatial relationship between adjoining message pieces 28 to assemble the custom message 50, in addition to the aesthetic value. Those skilled in the art will appreciate that other design combinations on the surface of the alphanumeric pieces 28 and graphic pieces 46 lie within the spirit and scope of the invention. For example, a sequence of adjoining pieces may include letters and numbers on a banner design.

Such a custom message can be a name, a birth date, a birthday message, an anniversary greeting, a marriage proposal, a message to commemorate a special occasion, or any other message. Blank pieces 48 or graphic pieces 46 can be used to separate words or groupings formed by the alphanumeric pieces 44.

In this preferred embodiment, alphanumeric pieces 44 are selected that allow composition of a predetermined custom message 50. Those skilled in the art will appreciate that other embodiments of the personalized custom puzzle lie within the spirit and scope of the invention. For example, additional alphanumeric pieces 44 may be included to allow for composition of other messages as desired by an end user.

The invention also includes a method for producing a personalized jigsaw puzzle 10 of the invention. The method for producing a personalized jigsaw puzzle 10 provides a picture section 12, with the picture section 12 made up of multiple picture pieces 20 interlocking with one another. In the preferred embodiment, each of the picture pieces 20 is uniquely shaped such that the picture pieces 20 interlock together in a single conformation. The top surface of the picture pieces 20 displays a complete puzzle picture when the picture pieces 20 are assembled.

The method for producing a personalized jigsaw puzzle 10 further includes manufacturing alphanumeric pieces 44. In the preferred embodiment, some of the alphanumeric pieces 44 have the same shape so that they are interchangeable with one another, allowing any of the alphanumeric pieces 44 to interlock with any other of the alphanumeric pieces 44.

The method for producing a personalized jigsaw puzzle 10 further includes manufacturing filler pieces 46, 48. In the preferred embodiment, the filler pieces 46, 48 have the same shape as the alphanumeric pieces 44 so that each of the filler pieces 46, 48 can interlock with any of the filler pieces 46, 48 or any of the alphanumeric pieces 44. Border pieces 38 are also provided to define the border of the personalized jigsaw puzzle 10.

In the preferred embodiment, the picture pieces 20 of the picture section 12 are combined with alphanumeric pieces 44. For each personalized jigsaw puzzle 10, a custom message 50 is selected. Those alphanumeric pieces 44 allowing for assembly of the custom message 50 are selected for addition to the picture pieces 20. Filler pieces 46, 48 are added, with the number of alphanumeric pieces 44 and filler pieces 46, 48 calculated to allow for completion of the personalized section 14. The personalized section 14 and picture section 12 are adapted to interconnect with one another.

This process allows for flexible creation of personalized jigsaw puzzles 10. Where longer messages are desired, pieces can simply be added, creating a larger puzzle having the requisite number of pieces needed to display the custom message 50. Likewise, a shorter message can either be provided on a puzzle with fewer pieces or having more filler pieces 46, 48. Thus, the method for producing a personalized jigsaw puzzle 10 further includes determining a puzzle size having sufficient pieces to display the custom message 50.

As the invention disclosed herein may be embodied in other specific forms without departing from the spirit or general characteristics thereof, some of which forms have been indicated, the embodiments described herein are to be considered in all respects illustrative and not restrictive. The scope of the invention is to be indicated by the appended claims, rather than by the foregoing description, and all changes which come within the meaning and range of equivalency of the claims are intended to be embraced therein.

I claim:

1. A personalized jigsaw puzzle having a personalized section that includes a plurality of message pieces selected for inclusion in the puzzle based on information from an end user and wherein the plurality of message pieces form a predetermined custom message that was selected by the end user, and with the plurality of message pieces interlocking with one another, with a predetermined portion of the plurality of message pieces being interchangeable such that each piece of the predetermined portion can interlock with any other piece of the predetermined portion, allowing the plurality of message pieces to combine in multiple conformations, with the plurality of message pieces including a number of alphanumeric pieces that display the custom message when the alphanumeric pieces are placed in a predetermined relationship to one another, and with the personalized section adapted to interlock with a picture section to form the personalized jigsaw puzzle; wherein the picture section includes a plurality of picture pieces which are shaped such that the picture pieces interlock together in only a single conformation, and wherein each of the plurality of picture pieces is a portion of a complete puzzle picture displayed when the plurality of picture pieces are interlocked together.

2. The jigsaw puzzle of claim 1 with the predetermined portion of the plurality of message pieces being interchangeable further comprising all non-border pieces of the personalized section.

3. The jigsaw puzzle of claim 1 with the plurality of picture pieces each having a substantially equal size and the plurality of message pieces each having substantially equal size.

4. The jigsaw puzzle of claim 3 with the plurality of picture pieces having a larger size than the plurality of message pieces.

5. The jigsaw puzzle of claim 1 with the predetermined portion of the plurality of message pieces being interchangeable further including pieces having an individual graphic.

6. The jigsaw puzzle of claim 1 with the predetermined portion of the plurality of message pieces being interchangeable further including blank pieces.

7. The jigsaw puzzle of claim 1 with the plurality of picture pieces including a greater number of pieces than needed to complete the personalized section, with the plurality of message pieces allowing for multiple alternative messages.

8. The jigsaw puzzle of claim 1, wherein the plurality of message pieces are all alphanumeric pieces that display the custom message when the alphanumeric pieces are placed in a predetermined relationship to one another.

9. The jigsaw puzzle of claim 1, wherein the puzzle includes a number of filler pieces.

10. The jigsaw puzzle of claim 9, wherein the number of filler pieces includes pieces having individual graphics thereon.

11. The jigsaw puzzle of claim 9, wherein the number of filler pieces includes pieces that are blank on a top surface.

* * * * *